United States Patent [19]

Cormier

[11] 4,335,865

[45] Jun. 22, 1982

[54] CURTAIN ROD BRACKET

[76] Inventor: Joseph A. Cormier, 136 Main St., Spencer, Mass. 01562

[21] Appl. No.: 83,114

[22] Filed: Oct. 9, 1979

[51] Int. Cl.[3] ..... F16M 13/00

[52] U.S. Cl. ..... 248/558; 248/216.1; 248/225.2; 248/263; 248/274

[58] Field of Search ..... 248/216.1, 220.3, 220.4, 248/221.1, 221.2, 225.2, 254, 255, 256, 262, 263, 274, 558

[56] References Cited

U.S. PATENT DOCUMENTS

| | | | |
|---|---|---|---|
| 510,835 | 12/1893 | Blair | 248/37.6 |
| 974,681 | 11/1910 | Le Manquais | 248/300 X |
| 1,403,004 | 1/1922 | Beckers | 248/226.5 X |
| 1,580,706 | 4/1926 | Wright | 248/263 X |
| 1,818,617 | 8/1931 | Grinwald | 248/226.5 X |
| 1,856,847 | 5/1932 | Gates | 248/226.5 X |
| 2,367,322 | 1/1945 | Wright et al. | 248/262 |
| 2,459,692 | 1/1949 | Fletcher | 248/300 X |
| 2,634,078 | 4/1953 | Aiello et al. | 248/262 |
| 2,770,437 | 11/1956 | Pasch | 248/262 |
| 4,146,204 | 3/1979 | Thalenfeld | 248/220.4 |

FOREIGN PATENT DOCUMENTS

| | | | |
|---|---|---|---|
| 1000556 | 8/1965 | United Kingdom | 248/274 |

*Primary Examiner*—William H. Schultz
*Attorney, Agent, or Firm*—Blodgett & Blodgett

[57] ABSTRACT

Bracket adapted to embrace the top edge of a window casing, including a connector in the form of a narrow loop of material to compensate for variations in casing thickness.

2 Claims, 3 Drawing Figures

CURTAIN ROD BRACKET

BACKGROUND OF THE INVENTION

The art of hanging curtain rods and the like is a very ancient and varied one. For many years, it was common practice to fasten the bracket to the front surface of a window casing by means of screws. This had the defect that it produced unslightly holes in the casing which had to be refilled and painted when it became desirable to move the brackets to another position on the casing. Furthermore, every time the window was painted, one either painted around the bracket or removed the bracket, painted the casing, and then replaced the bracket, this involving a time-consuming operation. In addition, when the bracket was replaced and the screws inserted in place they tended to be loose, thus causing the brackets to fall off at times. It was subsequently suggested, therefore, that the bracket take the form of a clip to extend over the front surface of the casing, along the top edge, and down the crack between the casing and the wall. Unfortunately, casings have various thicknesses and a given size of clip would not fit all casings. The suggestion was made, of course, that the clip be formed in two parts with slots and screws to make them adjustable. This arrangement, however, is expensive. Furthermore, it becomes a gathering place for dirt and other detritus. Furthermore, such complex arrangements usually have sharp edges on which curtains and draperies can become caught and which cause tearing. These and other difficulties experienced with the prior art devices have been obviated in a novel manner by the present invention.

It is, therefore, an outstanding object of the invention to provide a curtain rod bracket that is adaptable to window casings of various thicknesses.

Another object of this invention is the provision of a single-piece curtain rod bracket that is applicable to a window casing.

A further object of the present invention is the provision of a bracket for holding curtain rods which bracket is simple in construction; which is inexpensive to manufacture, and which is capable of a long life of useful service.

It is another object of the instant invention to provide a window bracket which has a minimum of sharp edges to cause damage to curtains or draperies.

A still further object of the invention is the provision of a curtain rod bracket which has a pleasing appearance.

With these and other objects in view, as will be apparent to those skilled in the art, the invention resides in the combination of parts set forth in the specification and covered by the claims appended hereto.

SUMMARY OF THE INVENTION

In general, the invention consists of a bracket for curtain rods and the like having a main body adapted to lie vertically along the front surface of a window casing and having an upper body adapted to lie along the upper horizontal surface of the casing. A pointed holding member extends downwardly from the inner end of the upper body and is adapted to lie between the casing and the wall. A pair of spaced parallel wings extend forwardly from the main body to engage and hold a curtain rod. A deformable connector joins the forward end of the upper body to the upper portion of the main body, thus permitting the distance from the main body to the holding member to be adjusted to the exact thickness of the casing.

More specifically, the connector consists of a relatively narrow band which is integral with the upper body and the main body, which connector is bent into a semi-cylindrical form or loop. The main upper body, holding member, wings, and connector are formed of a single piece of sheet metal.

BRIEF DESCRIPTION OF THE PREFERRED EMBODIMENT

The character of the invention, however, may be best understood by reference to one of its structural forms, as illustrated by the accompanying drawings, in which.

DESCRIPTION OF THE PREFERRED EMBODIMENT

Figure 1:
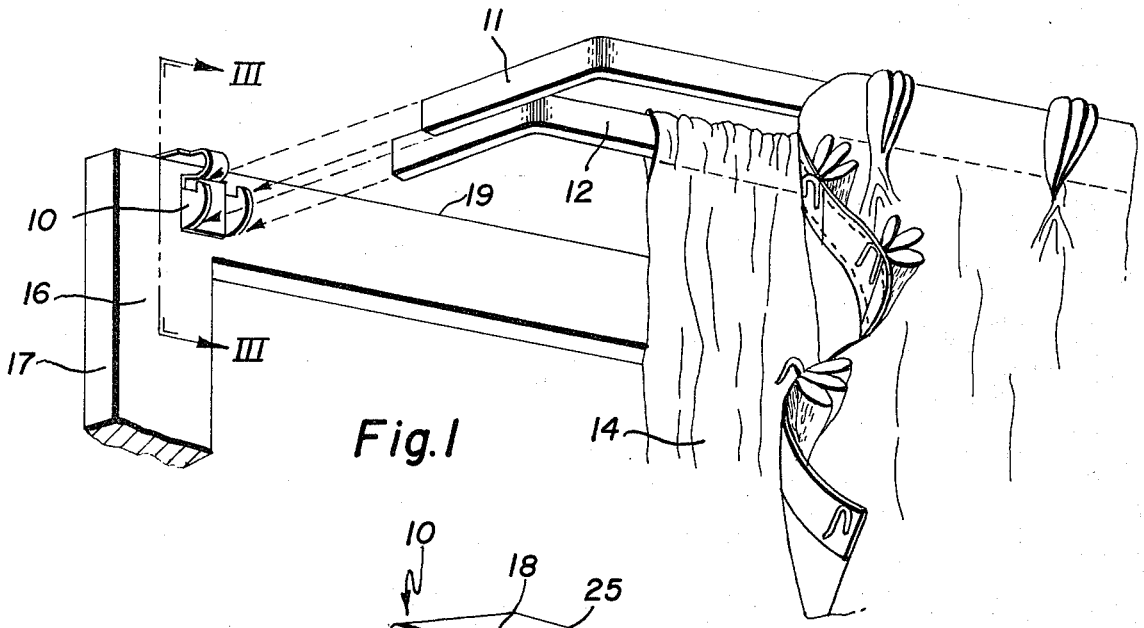
FIG. 1 is a perspective view of a curtain rod bracket incorporating the principles of the present invention and shown in use with a window.

Referring first to FIG. 1, wherein are best shown the general features of the invention, the curtain rod bracket, indicated generally by the reference numeral 10, is shown in use with two curtain rods 11 and 12 that support a drape 13 and a curtain 12, respectively. The bracket 10 is shown as engaging the front surface 16 of a window casing 17, as well as the upper edge surface 19.

Figure 2:
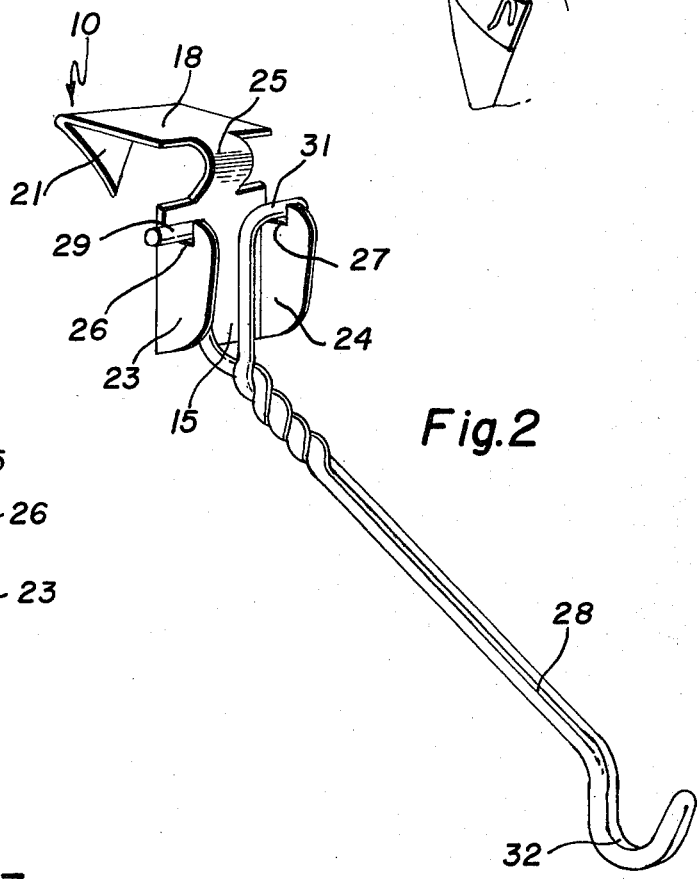
FIG. 2 is an enlarged perspective view of the bracket showing the details of its construction in use with an associated hanger.
Figure 3:
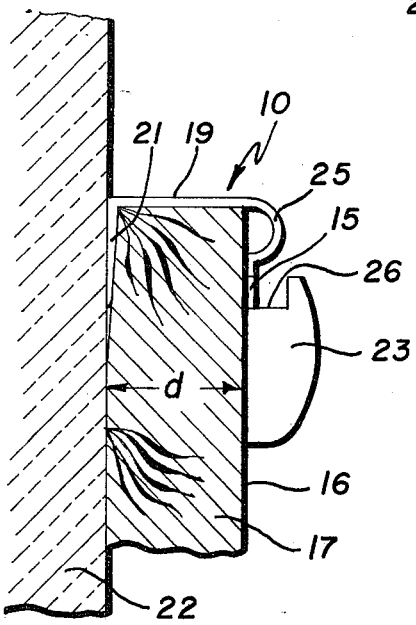
FIG. 3 is a vertical sectional view taken on the line III—III of FIG. 1.

FIGS. 2 and 3 show that the bracket 10 is provided with a main body 15 which is adapted to lie vertically along the front surface of the window casing 17. It is provided with an upper body 18 adapted to lie along the upper horizontal surface 19 of the casing. A pointed holding member 21 extends downwardly from the inner end of the upper body and is adapted to lie between the window casing and the surface of the wall 22. A pair of spaced parallel wings 23 and 24 extend forwardly from the main body 15 and are shaped to receive the ends of curtain rods, such as the curtain rods 11 and 12. A deformable connector 25 joins the main body 15 to the upper body 18, thus permitting the distance from the main body to the holding member 21 to be adjusted to the exact thickness of the casing 17. The connector 25 is in the form of a relatively narrow band which is integral with the upper body and the main body and which is bent into a loop with a semi-cylindrical form or shape.

As is evident in the drawings, the main body 15, the upper body 18, the holding member 21, the wings 23 and 24, and the connector 25 are formed of a single piece of sheet metal. The main body 15 and the upper body 18 are in the form of flat rectangular plates lying in planes that are at a right angle to one another. The connector 25 is substantially narrower than the main body and the upper body and joins the center portion of the adjacent edges. Each wing 23 and 24 is provided with a notch 26 and 27 at its upper portion. A hanger 28 has a wide-form shape, each of the two arms 29 and 21 engaging and being supported by a notch 26 and 27, respectively. The leg has a hook 32 to support a decorative object, such as a flower pot.

The operation and advantages of the present invention will now be readily understood in view of the above description. In order to use the curtain rod bracket 10, it is the usual practice to provide one at each end of the casing of the window. The bracket is pressed over the top of the casing and the holding member 21 slides easily behind the casing between the rear surface of the casing and the surface of the wall 22. This is permitted, because the holding member is pointed and because the resilience of the wall 22 and of the casing allows such an object to be inserted easily. If the distance "d" (shown in FIG. 3) between the front surface 16 of the casing and its rear surface is the same as the manufactured distance between the holding member 21 and the main body 15, then no adjustments need to be made. The curtain rods 11 and 12 are pressed over the wings 23 and 24, respectively, and the horns provided in the wings by the notches 26 and 27 rest in apertures in the curtain rods to hold them securely in the well-known manner. In some cases, a curtain 14 is provided on the curtain rod 12, while a drapery 13 is provided on the curtain rod 11, the selection of a number of curtain rods and the article suspended from them being within judgement of the householder. If, as is often the case, the bracket does not fit properly over the casing because the distance "d" of the casing is other than a more-or-less standard dimension, then the resilience and the pliability of the narrow connector 25 permits an adjustment to be made. It is a simple matter by the use of a pair of pliers to make this adjustment. It is desirable to make the adjustment, so that, even though the distance between the main body 15 and holding member 21 has been changed, the distance is still somewhat less than the thickness "d" of the casing, so that the inherent resilience of the connector 25 allows a firm clamping action of the main body 15 against the front surface 16 of the casing 17. Such resilient clamping action assists in preventing the bracket from being shaken loose by house vibrations due to traffic and the like. In some situations it may be desirable to use the hanger 28, making use of the notches 26 and 27 for suspending a light-weight ornament or decoration, such as a hanging plant. It can be seen, then, that the use of the present bracket permits an adjustment for various sizes of casings and it allows the bracket to be added to a window without substantially marring the painted surface. Furthermore, in order to point the casing around the window, it is very easy to remove the bracket and replace it when the point is dry. Because the bracket of the present invention is made of one piece of sheet metal, it can be formed inexpensively and simply. There are no intricate adjusting means to catch and tear curtains or to gather dust.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Curtain rod bracket, comprising:

(a) a main body in the form of a flat plate adapted to lie vertically along the front surface of a window casing, (b) an upper body in the form of a flat plate adapted to lie along the upper horizontal surface of the casing, (c) a pointed holding member extending downwardly from the inner end of the upper body and adapted to lie between the casing and the wall, (d) a pair of spaced, parallel wings each extending forwardly from the main body to engage and hold a curtain rod, and (e) a deformable arcuate connector which is substantially narrower than the upper body and the main body, said connector being integral with the main body and the upper body and joining the central portion of the forward edge of the upper body to the central portion of the upper edge of the main body, thus permitting the distance from the main body to the holding member to be adjusted to the exact thickness of the casing, each wing being provided with a notch at its upper portion, and a hanger being provided that has a Y-form shape which includes two arms and a single leg joined to the two arms, each of the two arms engaging and being supported by a notch, and the leg having a hook to support a decorative object.

2. Curtain rod bracket as recited in claim 1, wherein the main body, upper body, holding member, wings, and connector are formed in one piece of sheet metal.

* * * * *